US006438968B1

(12) United States Patent
Varrassi et al.

(10) Patent No.: US 6,438,968 B1
(45) Date of Patent: Aug. 27, 2002

(54) INSTALLATION FOR STORAGE OF A LIQUIFIED GAS UNDER PRESSURE

(75) Inventors: Lucien Varrassi; Patrick Fontanille, both of Ennery (FR)

(73) Assignee: Cryolor, Ennery (FR)

( * ) Notice: Subject to any disclaimer, the term of this patent is extended or adjusted under 35 U.S.C. 154(b) by 0 days.

(21) Appl. No.: 09/715,264

(22) Filed: Nov. 20, 2000

(30) Foreign Application Priority Data

Nov. 22, 1999 (FR) ..... 99 14648

(51) Int. Cl.[7] ..... F17C 13/02
(52) U.S. Cl. ..... 62/49.2; 62/50.1
(58) Field of Search ..... 62/48.1, 49.1, 62/49.2, 50.1

(56) References Cited

U.S. PATENT DOCUMENTS 3,455,316 A 7/1969 Rogers
5,275,007 A 1/1994 Neeser
5,293,750 A * 3/1994 Tamura et al. ..... 62/47.1
5,467,603 A 11/1995 Lehman et al.
5,628,349 A 5/1997 Diggins et al.

FOREIGN PATENT DOCUMENTS

EP 0 744 576 11/1996

* cited by examiner

*Primary Examiner*—William C. Doerrler
*Assistant Examiner*—Malik N. Drake
(74) *Attorney, Agent, or Firm*—Young & Thompson

(57) ABSTRACT

An installation for the storage of a liquified gas under pressure in a pressure chamber. The installation includes a closed pressure resistant chamber to contain the liquid. The container has a wall whose thickness $e_s$ is determined by computations taking into account parameters associated with a pressure $P_s$ within the chamber and a temperature $T_s$<−50° of the wall of the chamber. The installation further includes a device to indicate a magnitude G of a temperature $T_s$ of the chamber wall and a device to indicate a magnitude G' representative of the computation temperature $T_s$. The installation also includes a device to compare the magnitudes G and G', and a device to lower the pressure to a value $P_2$ below the computed pressure $P_s$ if as a result of the comparison, $T_e$ is greater than $T_s$.

18 Claims, 1 Drawing Sheet

INSTALLATION FOR STORAGE OF A LIQUIFIED GAS UNDER PRESSURE

The present invention has for its object an installation for storage of a liquified gas under pressure in a pressure chamber and a process for storage of a liquified gas under pressure in such a chamber.

Industrial gases such as oxygen, nitrogen, argon which are very widely used in all sectors of industry are distributed in large part in the form of liquid at low temperature and are stored at the user site in a cryogenic chamber most often called an "evaporator" whose design pressure is generally comprised between 10 and 20 bars. The cost of the evaporators greatly increases the cost of industrial gases for the user. However, nearly half this cost comes from the metal, most often austenitic stainless steel, of which the pressure container is made that contains the cryogenic liquid. There is thus a real interest in being able to build chambers or evaporators whose cost would be reduced relative to the present cost.

Moreover, it will be understood that, for obvious safety reasons, the computation of the dimensions of the chamber or the vat must be carried out very carefully according to the standard EN 10 028-7 annex F.

In the accompanying FIG. 1, there is shown such an installation of known type, which is constituted by the cryogenic chamber 12 resistant to pressure, in which liquified gas 14 is stored. The installation also comprises a withdrawal conduit 16 at the lower part of the vat as well as a safety valve 18 connected to the upper portion of the chamber 12. Most often, the installation is also provided with a system 20 for detection of the level of the liquid 22 in the vat. This system 20 permits giving the percentage of the height of the chamber occupied by the liquid and is based on a differential pressure measurement. This measurement permits controlling the filling of the chamber when the percentage falls below 30%.

In computations aimed at determining the dimensional characteristics of the cryogenic chamber which use the standard mentioned above, there is taken into consideration a temperature equal to the ambient temperature as well as a service pressure which corresponds to the opening pressure of the safety valve 18.

SUMMARY OF THE INVENTION

A first object of the invention is to provide a storage installation for a liquified gas under pressure, which permits lowering the cost substantially in that it relates to the quantity of metal used for the pressure chamber whilst maintaining of course the safety conditions strictly equivalent to those which are required by the standards.

To achieve this object according to the invention, the storage installation for a liquified gas under pressure in a pressure chamber comprises:

- a closed chamber resistive to pressure to contain said liquid, said chamber comprising a wall whose thickness is determined by computations taking into account the parameters connected with a pressure $P_s$ within said chamber and at a temperature $T_s$ less than −50° C. of the wall,
- means to work out a magnitude G representative of the effective temperature $T_e$ of the wall of the chamber, means to work out a magnitude G' of the same nature as G and representative of the computation temperature $T_s$,
- means to compare the magnitudes G and G',
- means to lower the pressure to a value $P_2$ less than the calculation pressure $P_s$ if it results from the comparison that $T_e$ is greater than $T_s$.

It will be understood that the invention is based on the one hand on the fact that the inventors have shown that so long as the quantity of liquid of the liquified gas contained in the vat is at least equal to 10%, the temperature of the wall of the chamber remains very much lower than the ambient temperature taken generally as a parameter for computation and that, more precisely, this temperature remains less than at least −50° C. and more precisely than −80° C. As a result, the computations of determination, particularly the thickness of the wall of the pressure chamber, are made on the basis of this temperature, which permits finding very substantially reduced thicknesses and hence a decrease of the quantity of steel to be used. On the other hand, the installation is so constructed that if the effective temperature of the chamber wall exceeds the temperature considered by the calculations, the valve is automatically controlled to drop the pressure within the chamber to a pressure substantially lower than that which was used for computing the thickness of the wall, whereby this temperature increase is compensated by the pressure decrease as to the requirements to which the chamber wall is subject.

According to a first embodiment, the magnitude G is the temperature itself in the chamber of the pressure receptacle.

According to a second embodiment, the magnitude used is the percentage of the height of the liquid contained in the pressure resistant chamber, which height is directly as was established by the inventors relative to the external temperature of the chamber wall. This modified embodiment has the advantage of using a liquid level detector in the pressure resistant chamber, which already exists in most installations.

Another object of the invention is to provide a process for the storage of liquified gas under pressure in a chamber.

This process is characterized in that it comprises the following steps:

- the thickness of the wall of said chamber is calculated using parameters corresponding to a pressure $P_s$ within the chamber and a temperature $T_s$ ($T_s$<−50° C.) of said chamber, from which is obtained a thickness $e_s$,
- a pressure resistant chamber is made whose thickness is equal to $e_s$,
- said chamber is filled with said liquified gas,
- a magnitude G is measured, representative of the effective temperature $T_e$ of the wall of said chamber as said gas within the chamber is progressively withdrawn,
- said measured magnitude G is compared to a reference magnitude (G') of the same nature as the measured magnitude G, representative of said temperature $T_s$,
- pressure in the chamber is lowered if the temperature $T_e$ becomes greater than the temperature $T_s$.

BRIEF DESCRIPTION OF THE DRAWINGS

Other characteristics and advantages of the invention will become more apparent from a reading of the description which follows of several embodiments of the invention given by way of non-limiting examples. The description refers to the accompanying drawings, in which.

DETAILED DESCRIPTION OF THE PREFERRED EMBODIMENTS

As has also been briefly indicated, the present invention is based on the following observations made by the inventors. Under normal conditions of use of these installations, the quantity of filling with liquid is between 30 and 100% because, in normal operation, the chamber is refilled as soon as the quantity of liquid filled is less than 30%. With this quantity of filling, the wall of the chamber remains at a temperature which never rises above −130° C. The inventors have also noted that, even if the quantity of filling were equal to 10%, the temperature of the wall of the chamber would never rise above −80° C.

In view of these observations, the invention proposes to compute the dimensions of the wall of the pressure storage chamber for a temperature of −80° C. or at least for a temperature substantially less than ambient temperature, for example −50° C., and for the standard service pressure $P_s$. The computations carried out under these temperature and pressure conditions permit decreasing the thickness of the chamber wall by 30 to 40% relative to what is conventionally obtained by using ambient temperature to carry out the computations.

So as to maintain the same degree of safety of the installation even in the case in which, for reasons altogether exceptional and accidental, the temperature of the chamber wall would descend below the temperature taken into consideration for the computations, which is to say if the quantity of filling becomes less than 10%, the installation is provided with detection means directly representing the temperature of the wall or preferably a magnitude correlated with this temperature and a limiter of the pressure to a pressure $P_1$ less than the service pressure to cause a fall in pressure within the chamber in case the computed temperature is exceeded.

Figure 1:
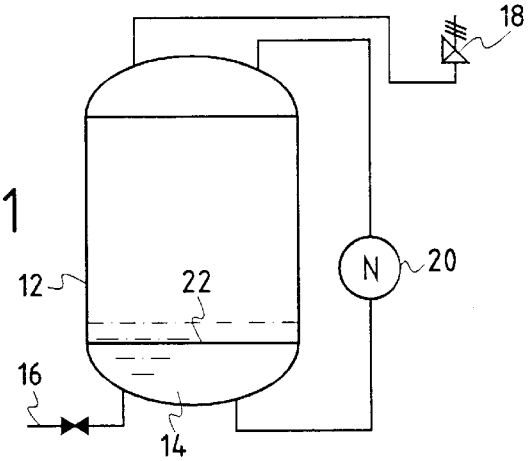
FIG. 1, already described, shows a known installation for the storage of liquified gas.
Figure 2:
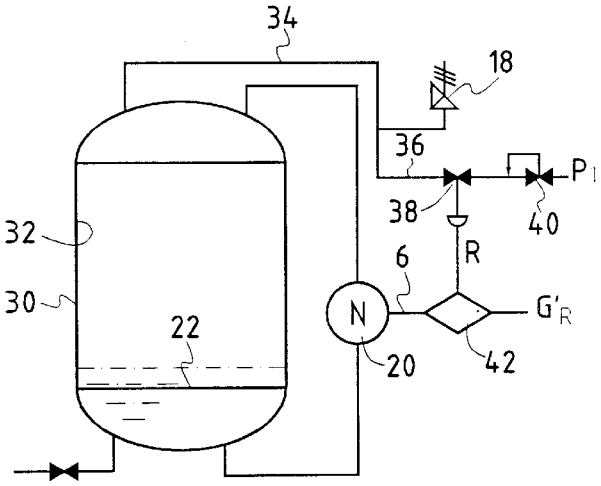
FIG. 2 shows a first embodiment of the chamber of the storage installation according to the invention.

Referring first of all to FIG. 2, there will be described a first embodiment of the storage installation for liquified gas. This installation comprises the vat 30 whose wall thickness 32 has been computed according to the standards in force for service pressure $P_s$ and for a service temperature $T_s$ equal to −80° C. The installation also comprises the control system 20 for the level of liquid 22 within this vat. The conduit 34 which places the safety valve 18 in communication with the interior of the chamber 30 is also connected by the conduit 36 to a controlled valve 38. This controlled valve is interposed between the conduit 36 and a pressure limiter 40 whose adjustment pressure is equal to $P_1$, $P_1$ being substantially below the surface pressure $P_s$ for which the chamber has been computed. The information as to percentage of height of liquid G worked out by the measurement device 20 is compared to a reference percentage G' in the comparator circuit 42. G' is selected to be equal to 12% and preferably equal to 10%. If the result of the comparison R is that the percentage of liquid is less than 10%, the valve 38 is controlled to open such that the interior of the vat will be connected to the pressure limiter 40 adjusted to the pressure $P_1$. Thus, in normal operation, so long as the percentage of the height of liquid G remains greater than G', the value 38 remains closed.

This solution is particularly interesting because it does not require any other detector than the measurement device for the liquid level.

Figure 3:
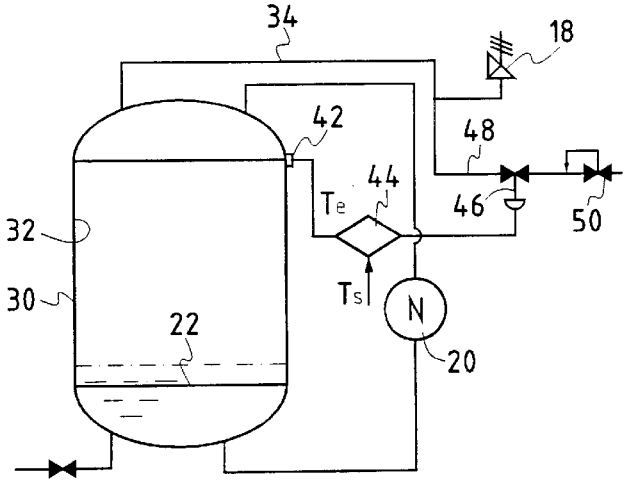
FIG. 3 shows a second embodiment of the storage installation according to the invention.

In FIG. 3, there is shown a second embodiment of the installation in which are seen the vat 30 with its wall 32 whose thickness has been computed as indicated above as well as the safety valve 18 connected to the chamber by the conduit 34 and the level measuring device 20. In this embodiment, there is disposed on the external surface of the wall 32 of the chamber at least one temperature detector 42 disposed adjacent the upper end of the chamber 30 and preferably a plurality of detectors 42 disposed at this same level which thus will deliver a signal representative of the external temperature of the chamber $T_e$. This temperature is compared in the comparator 44 with a signal representative of the temperature $T_s$ at which the computation has been carried out, which is to say corresponding to a value of −80° C. The result of this comparison serves to control a valve 46 which is interposed in the conduit 48 between the interior of the chamber 30 and a pressure limiter 50 adjusted to the value $P_1$ below the surface pressure $P_s$. If the measured temperature $T_e$ becomes greater than the reference temperature $T_s$, the valve 46 is opened and the interior of the chamber 30 is connected to the pressure limiter 50.

This solution is more interesting when it is not necessary that the storage installation comprise a liquid level control device or in the case in which the device exists but does not produce a signal, for example an electrical one, which would permit controlling the valve.

It results from the above disclosure that, according to the invention, it is possible to provide a cryogenic pressure chamber whose thickness is very substantially reduced because there is used as the temperature for computing this thickness a temperature very much below the ambient temperature, this temperature being −50° C. or preferably −60° C., without changing the safety of operation of the installation.

What is claimed is:

1. Pressurized liquid gas installation for storing a liquefied gas under pressure in a pressure chamber, comprising:

a pressure resistant closed chamber to contain said liquid, said chamber comprising a wall whose thickness $e_s$ is determined by computation taking into account the parameters connected to a pressure $P_s$ within said chamber at a temperature $T_s$<50° C. for the wall of said chamber, means to work out a magnitude G representative of the effective temperature $T_e$ of the chamber wall, means to work out a magnitude G' of the same nature as G and representative of the computed temperature $T_s$, means to compare the magnitudes G and G', and means to lower the pressure to a value $P_2$ below the computed pressure $P_s$ if the comparison shows that $T_e$ is greater than $T_s$.

2. Installation according to claim 1, characterized in that the magnitude G is the temperature of the chamber $T_e$ itself and in that the magnitude G' is a temperature for computing $T_s$ itself.

3. Installation according to claim 1, wherein the magnitude G is a percentage of a height of the chamber occupied by a liquid, and said magnitude G' is below 30%, said pressure $P_s$ within said chamber being brought back to $P_2$ when G is less than G'.

4. Installation according to claim 3, wherein said temperature $T_s$ is −80° C. and said magnitude G' is between 15 and 10%.

5. Installation according to claim 3, characterized in that said means to work out the magnitude G comprises a device for determining the liquid level within the chamber.

6. Installation according to claim 1, characterized in that said means to lower the pressure comprise:

a device for limiting pressure to said pressure $P_2$, a conduit to connect the upper portion of said chamber to said pressure limiting device, a controllable valve mounted on said conduit and closed at rest, means to control the opening of said valve in response to the result of said comparison.

7. Installation according to any claim 1, characterized in that said chamber is of austenitic stainless steel.

8. Installation according to claim 1, characterized in that said liquified gas is selected from the group consisting of nitrogen, oxygen and argon.

9. Process for storage of a liquified gas under pressure in a pressure resistant chamber, comprising the following steps:

computing the thickness of the wall of said chamber by using parameters corresponding to a pressure $P_s$ within the chamber and to a temperature $T_s$ ($T_s$<−50° C.) of said chamber, by which there is obtained a thickness $e_s$, providing a pressure resistant chamber whose thickness is equal to $e_s$, filling said chamber with said liquified gas, measuring a magnitude G representative of temperature $T_e$ effective on the wall of said chamber progressively as said internal gas in said chamber is withdrawn, comparing said measured magnitude G to a reference magnitude (G') of the same nature as the measured magnitude G, representative of said temperature $T_s$, lowering the pressure in the chamber to a value $P_2$ lower than $P_s$ if the temperature $T_e$ becomes greater than the temperature $T_s$.

10. A pressurized liquid gas installation, comprising:

a pressure chamber having a wall thickness defined by a calculation determined by a safety standard for a calculation ambient temperature ≦K, for storing a liquefied gas under a service pressure $P_s$;

a measuring device for measuring a level of liquefied gas in the pressure chamber;

a control valve, a conduit being connected between the pressure chamber and a first side of the control valve;

a pressure limiter connected to a second side of the control valve and having an adjustment pressure $P_1$, $P_1$ <$P_s$; and a comparator circuit for comparing the measured level of liquefied gas in the circuit, with a reference level, wherein when the measured level is less than the reference level, as detected by the measuring device and compared by the comparator circuit, the control valve is opened and the pressure limiter lowers the adjustment pressure;

wherein the pressure chamber in the liquid gas installation is disposed in an environment having an actual ambient temperature of >K.

11. The gas installation of claim 10, wherein the safety standard is EN 10 028-7 annex F.

12. The gas installation of claim 10, wherein K is −50° C.

13. The gas installation of claim 10, wherein K is −80° C.

14. The gas installation of claim 10, wherein the reference level is about 10% of a full level of the pressure chamber.

15. A pressurized liquid gas installation, comprising:

a pressure chamber having a wall thickness defined by a calculation determined by a safety standard for a calculation ambient temperature ≦K, for storing a liquefied gas at a service pressure $P_s$ and a service temperature $T_s$;

at least one temperature measuring device for measuring a temperature $T_e$ of an external wall of the pressure chamber;

a control valve, a conduit being connected between the pressure chamber and a first side of the control valve;

a pressure limiter connected to a second side of the control valve and having an adjustment pressure $P_1$, $P_1$ <$P_s$; and a comparator circuit for comparing the external wall temperature, with the service temperature, wherein when the measured external temperature is greater than the service temperature, the control valve is opened and the pressure limiter lowers the adjustment pressure which correspondingly lowers the external wall temperature;

wherein the pressure chamber in the liquid gas installation is disposed in an environment having an actual ambient temperature of >K.

16. The installation as claimed in claim 15, wherein the safety standard is EN 10 028-7 annex F.

17. The installation as claimed in claim 15, wherein K is −50° C.

18. The installation as claimed in claim 15, wherein K is −80° C.

* * * * *